US005292411A

United States Patent [19]

Bartholomew et al.

[11] Patent Number: 5,292,411

[45] Date of Patent: Mar. 8, 1994

[54] METHOD AND APPARATUS FOR CATHODICALLY PROTECTING REINFORCED CONCRETE STRUCTURES

[75] Inventors: John J. Bartholomew, Mentor; John E. Bennett, Chardon; Barry L. Martin, Concord; Thomas A. Mitchell, Mentor, all of Ohio

[73] Assignee: ELTECH Systems Corporation, Boca Raton, Fla.

[21] Appl. No.: 892,913

[22] Filed: Jun. 3, 1992

Related U.S. Application Data

[63] Continuation-in-part of Ser. No. 580,033, Sep. 7, 1990, abandoned.

[51] Int. Cl.[5] ..... C23F 13/00

[52] U.S. Cl. ..... 204/147; 204/148; 204/196; 204/197; 204/279

[58] Field of Search ..... 204/147, 148, 196, 197

[56] References Cited

U.S. PATENT DOCUMENTS 4,692,066 9/1987 Clear ..... 204/196

FOREIGN PATENT DOCUMENTS 0280427 8/1988 European Pat. Off. .

0479337 8/1992 European Pat. Off. .

OTHER PUBLICATIONS

Raychem Ferex 100, Feb., 1984, 2 pages.

*Primary Examiner*—T. Tung

*Attorney, Agent, or Firm*—John J. Freer

[57] ABSTRACT

Cathodic protection of a reinforced concrete structure utilizes a metal anode such as a zinc anode in combination with a pressure sensitive ionically conductive hydrogel in contact with at least a portion of the surface of the anode. Preferably, the anode and ionically conductive hydrogel are flexible and supplied in roll form. The combination may further include the addition of salt to the hydrogel as well as application to the metal-hydrogel combination of Type III cement. The cathodic protection may be carried out with or without a power source.

12 Claims, 1 Drawing Sheet

METHOD AND APPARATUS FOR CATHODICALLY PROTECTING REINFORCED CONCRETE STRUCTURES

CROSS-REFERENCE TO RELATED APPLICATION

This application is a continuation-in-part of U.S. patent application Ser. No. 580,033 filed Sep. 7, 1990, and now abandoned.

BACKGROUND OF THE INVENTION

1. Technical Field

The present invention relates to a method and apparatus for cathodically protecting reinforced concrete structures, such as the decks or substructures of bridges, wharfs and parking garages. The present invention especially relates to a cathodic protection apparatus which can be utilized in a variety of applications, e.g., from patching old concrete to installation in new construction.

2. Description of the Prior Art

Steel corrosion, in steel reinforced concrete structures, is the result of electrical current flowing from one point of the steel reinforcement to another. Such corrosion is enhanced by moisture and salt contamination of the concrete. Conventional cathodic protection applies an external direct current to the steel reinforcement from a current distribution anode which is in intimate contact with the concrete surface. The current from the distribution anode counteracts the corrosive current.

A technical bulletin captioned "Raychem Ferex 200 Cathodic Protection for Reinforced Concrete Structures" discloses a cathodic protection system for reinforced concrete structures. The system comprises flat anode strips and plastic channels by which the anode strips are attached to the underside of a concrete structure. The anode strips comprise an anode and a gel-like material which provides contact between the anode and the concrete structure. The gel-like material also conforms to irregularities in the concrete surface. The system is installed by preparing the surface of the concrete, attaching the anode strips and support channels to the prepared surface, wiring the system together, and then connecting the system to a power source. The anodes are in the form of an anode wire made of a conductive polymer electrode material coated onto copper conductors. The conductive polymer serves as an active anode material and also shields the copper conductors from chemical attack.

U.S. Pat. No. 4,812,212 discloses an anode structure for cathodic protection of the reinforcing members of reinforced concrete. The anode structure comprises an electrically conductive graphite tape. The tape is connected to a direct current power source. An electrically insulating backing is disposed between the tape and the surface of the reinforced concrete. The anode also has a conductive mastic or polymer which covers the graphite tape and which extends beyond the edges of the tape onto the concrete surface. The conductive mastic or polymer distributes a cathodic protection current from the graphite tape to the reinforced concrete.

U.S. Pat. No. 4,496,444 discloses an anode for cathodic protection of a metallic structure, such as a steel pipe, subject to corrosion. The anode comprises a strip or band of sacrificial anodic material. The strip or band has a pressure sensitive adhesive layer which permits the strip or band to be adhesively secured directly to the metallic structure. The adhesive layer is electrically conductive, and has a protective covering which permits the anode to be rolled up without adhesion between adjacent windings of the anode. Examples of adhesives disclosed in the patent are acrylic glues or vinyl glues.

U S. Pat. No. 4,506,485 discloses a system for cathodic protection of reinforced concrete structures. The system comprises a current distributing anode coating of zinc metal which is flame-sprayed onto at least a part of the exposed concrete surface. The zinc anode coating is connected with the reinforcing steel through a power source by which current flow is induced from the coating to the reinforcing steel. By flamespraying the metal onto the concrete, a coating is obtained which, in contrast to a metal paint, is free of a binder, and thus is more conductive. The flamesprayed metal anode coating more effectively distributes the cathodic protective current to the reinforced concrete structure than a metal paint.

In addition to strips or tapes, or sprayed systems of sacrificial metal applied to the surface of an object to be protected, it has also been known to cut channels into concrete and to place a sacrificial metal anode in the channel. Danish Patent No. 104,493 discloses cutting channels into concrete near steel reinforcement and then placing magnesium anodes into the channel. A resilient, preferably foam, material can be placed in the channel with the anode. This material can be compressed by the expansive corrosion products resulting from the corrosion of the sacrificial anode.

SUMMARY OF THE INVENTION

The method of the present invention for cathodically protecting a reinforced concrete structure comprises adhering a metal anode such as a zinc anode sheet to a surface of the concrete structure. A pressure sensitive coating of an ionically conductive hydrogel is on a surface of the anode. Preferably, the anode and coating of ionically conductive hydrogel are flexible and supplied in roll form. The present invention can include unrolling the coated anode and conforming the same to the surface of the concrete structure by pressure application of the hydrogel coating onto the surface. Particularly where deicing salts have been used on concrete, or where the concrete may be in a marine application or adjacent a marine environment, and thus, for example may be exposed to salt spray, the steel reinforcement can corrode. This corrosion leads to expansion of the steel reinforcement and can result in spalling of the concrete, plus delamination, causing potholes at the surface of the concrete, such as for example on a bridge deck. Concrete may be patched by pouring additional new concrete to fill the pothole. Usually, before filling, the old, e.g., delaminated, concrete is removed prior to patching. A problem is created in that the new overlay only tends to hide corrosion which continues within the old contaminated concrete. After a few years, continued corrosion will again cause the concrete to crack and spall.

The invention is particularly well suited for patching such old concrete, e.g., at potholes. The coated anode is placed in the pothole. The coated anode then has applied thereto a grout such as ASTM Type III, CSA High-Early-Strength cement, one of the five types of portland cement designated in ASTM C150 and usually referred herein simply as "Type III" cement, and this grout may then be covered with concrete. The invention may also find utility in new construction, with the anode being used in conjunction with epoxy coated steel reinforcement for the concrete. Furthermore, the anode may be placed on site and covered with a more conventional floor covering, as where the anode is applied to a reinforced concrete balcony exposed to a salt air environment and the balcony subsequently has carpet applied over the anode. In any case, the cathodic protection can be carried out with or without a power source.

In one broad aspect, the invention is directed to a method of patching an eroded area of a reinforced concrete structure, which method comprises:

(a) removing old concrete from the eroded area to prepare the area for patching;

(b) inserting in the resulting prepared area a cathodic protection anode assembly comprising a metal anode having ionically conductive hydrogel adhered to the anode, such hydrogel of the assembly being also adhered to the concrete of the prepared area;

(c) applying Type III cement to the anode assembly; and (d) connecting the metal anode of the assembly in electrical connection to the reinforcement of the concrete structure.

In another broad aspect, the invention is directed to an apparatus for cathodically protecting the reinforcement of a reinforced concrete structure, such apparatus comprising:

(a) an elongated metal anode;

(b) ionically conductive hydrogel having size at least substantially coextensive with the metal anode, such hydrogel being self-adhered to the metal anode, with the hydrogel having a resistivity less than about 100,000 ohm-cm; and (c) Type III cement in contact with the anode.

In another aspect the invention is directed to the anode-plus-hydrogel wherein salt addition is made to the hydrogel. In yet a further aspect, the invention is directed to the hydrogel as an ionic conductor in cathodic protection of concrete wherein the hydrogel is in contact with more than one anode, or in contact with an anode as well as with a current lead. Other invention aspects include cathodically protecting epoxy coated steel reinforcement, as well as providing protection between reinforced concrete and a floor covering, as well as making cathodic protection anode assemblies and the use of such assemblies.

The hydrogel for use in the present invention can have a plastic backing on a surface of the hydrogel that is not adhered to the anode, with the backing being peelable from the hydrogel. In a preferred embodiment, the anode and the hydrogel in combination are in roll form having a flexibility effective for conforming the same to the surface of the concrete structure to which it is applied. In anode use, the peelable backing will most always be removed from the hydrogel.

DESCRIPTION OF PREFERRED EMBODIMENT

Figure 1:
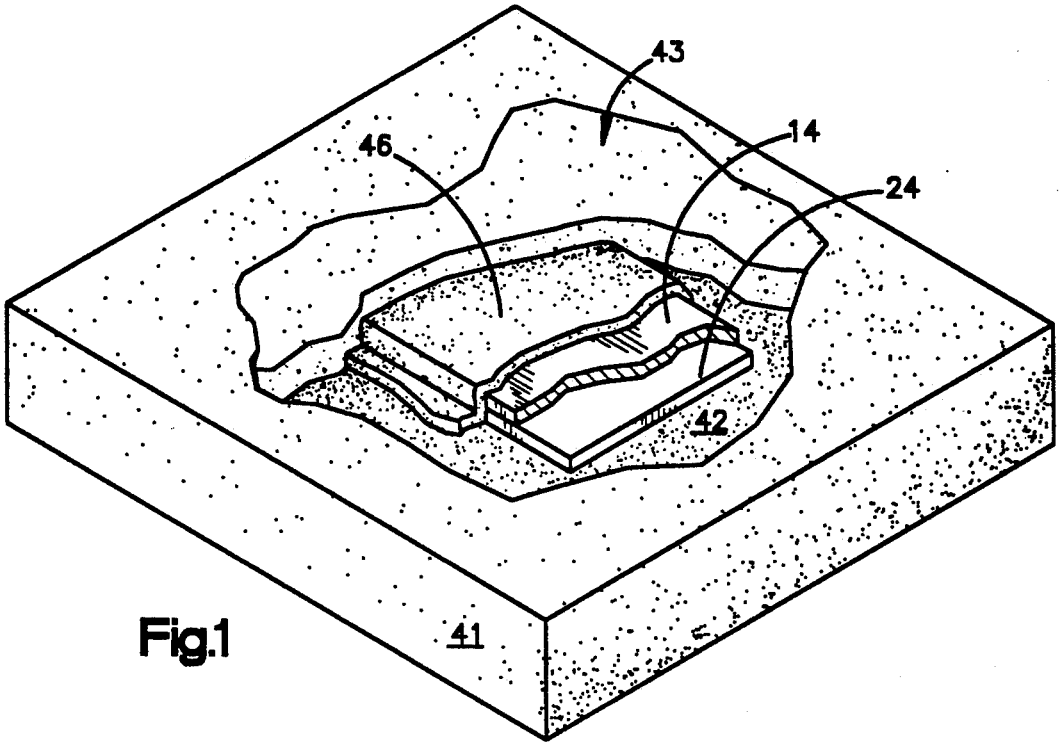
FIG. 1 is a perspective view of concrete protected in a manner of the present invention.

The hydrogel and the metal anode are typically in a sheet form of some kind, e.g., strip form, and in this form each have wide faces that can be pressed together. However, it is to be understood that other forms for the anode, e.g., wire form, are also contemplated. When the metal anode and the hydrogel are combined, they can be referred to herein as the "activated" anode or "coated" anode assembly or, with or without either an applied grout or a peelable plastic backing on the hydrogel, can be referred to more simply as the anode "assembly". It is however to be understood that the anode may be more completely coated with hydrogel than on just one surface, i.e., it may be embedded in the hydrogel with very little anode surface exposed, or it may be totally encapsulated or submerged, in the hydrogel, such as for use in the patching of a pothole. Any of these activated forms of the anode can then be covered with Type III cement. Although other material may be used in contact with the activated anode, including other types of cements, for best serviceability of the anode, the preferred cement is Type III cement. It will be understood that although reference may be made herein to covering the anode with cement, the cement will most always be applied to the activated anode in slurry form, that is after mixing the cement with aqueous medium, e.g., water.

A hydrogel can be defined as a gel which will most often, although not always, have a high water content, e.g., 60 weight percent water or more, which gel is produced by the coagulation of a colloid with the inclusion of water. As the word "hydrogel"0 is used herein, it is meant to include any ionically conductive adhesive gel which is a coagulated colloid that typically is a viscous and tacky, jellylike product. In broad terms, water can be present in the hydrogel in an amount from about 5% to about 95% by weight based on the weight of the hydrogel and is usually present in major weight amount, e.g., 70–90 weight percent. Preferred hydrogels of the present invention are organic, polymeric structures which have a molecular weight sufficiently high for the hydrogels to be selfsupporting. It is to be understood however that inorganic, polymeric structured hydrogels may also be used, e.g., those based on polysilicates or polyphosphates. Moreover, the use of mixtures of organic and inorganic hydrogels is also contemplated. The self-supporting hydrogels are form stable under normal conditions, usually in sheet form as used in the present invention, and have good ionic conductivity, as well as good adhesiveness or tackiness. Preferably, the hydrogels are pressure sensitive adhesives. The adhesive properties of the hydrogels are those effective for adherence of the anode assemblies of the present invention to a surface of a concrete structure over an extended period of time.

The hydrogels should also have good mechanical strength, permitting them to withstand the wear and tear of years of use. The hydrogels may contain, embedded into the interior of the hydrogels, a reinforcing mat or non-woven fabric to provide tensile strength. Such fabric reinforced hydrogels are commercially available. The hydrogels also have good resistance to syneresis, preventing water loss that would tend to reduce or lessen conductivity and adhesive properties. Further, the hydrogels should have sufficient flexibility that they can be made to conform to the irregularities of a surface of a reinforced concrete structure, providing an interface with the surface with a minimum of voids.

A number of hydrogels having the foregoing properties are commercially available. U.S. Pat. No. 4,391,278 discloses a flexible self-supporting, conductive, adhesive of a polymerized material which is suitable as a hydrogel for the present invention. The conductive adhesive can be 2-acrylamido-2-methylpropanesulfonic acid, or a soluble salt of the acid. The acid monomer is dissolved in distilled water, initiators can be added, and the mixture then poured into a tray to form a sheet. The mixture rapidly gels to a flexible material with adhesive and conductive qualities.

U.S. Pat. No. 4,617,935 discloses a polymeric conductive adhesive, characterized as a urethane hydrogel. The hydrogel is of a gelatinous consistency and contains an electrolyte in an amount sufficient to render the polymeric medium conductive. U.S. Pat. No. 4,635,642 also discloses a urethane hydrogel which contains an electrolyte in an amount sufficient to render it conductive. Examples, of suitable electrolytes are ionizable salts such as sodium chloride in aqueous medium, e.g., water. These urethane hydrogels are representative of hydrogels that are deemed useful in the present invention.

U.S. Pat. No. 4,515,162 discloses a hydrogel which comprises a hydrophilic polymer, water and a cross-linking component. Suitable hydrophilic polymers are polyacrylic acid and a polyacrylic acid salt. Cross-linking agents are compounds containing at least two epoxy groups in the molecule. The polyacrylic acid and polyacrylic acid salt have an average degree of polymerization of from about 100 to 100,000. Examples of cross-linking components are triglycidyl isocyanurate, polyethylene glycol diglycidyl ether, ethylene glycol diglycidyl ether and the like. Tackiness of the hydrogel can be controlled by the amount of the cross-linking component added.

The hydrogels can have a maximum resistivity of less than about 100,000 ohm-cm., usually less than 50,000 ohm-cm. and more typically on the order of from about 800 to about 2,500 ohm-cm. For an anode assembly in roll form, the hydrogel layer generally has a thickness within the range of from about 0.02 to 0.05 inch, and more usually from about 0.025–0.04 inch. A preferred hydrogel is marketed by Promeon Division of Medtronic, Inc. under the trademark PROMEON. The PROMEON hydrogels marketed under the trade designation RG62 have high tack and high dryout resistance and thus maintain moisture content and adhesive tack over long periods of time. This hydrogel is marketed in roll form.

The hydrogels as commercially prepared may contain additives such as tackifiers, can also have an electrolyte such as sodium chloride or potassium chloride in aqueous medium, and can contain flexibility imparting agents and the like. Furthermore, it may be advantageous to add ionizable salts to the commercially available hydrogel, usually by the addition of inorganic salts, which can be in addition to salts already present in the electrolyte of the gel. Useful added salts include alkali metal salts, e.g., sodium or potassium chloride, or both. Advantageously for enhanced anodic activity, the salt is one or more of the more hydrophilic alkaline earth metal salts, such as a magnesium or calcium salt. Most always, the added ionizable salt will be a halide salt, with chloride being most useful and magnesium chloride being the preferred, added salt. Usually from about 2 to about 20 weight percent, and more typically from about 5 to about 15 weight percent, of these salts can be added.

The anodes used in the present invention are usually in elongated form such as wire or strip or ribbon form. Generally all of the anodes will be metal anodes and, particularly in or near a marine environment, they will most always be composed of a sacrificial metal, such as aluminum, zinc, magnesium, alloys or intermetallic mixtures of these metals with one another, or alloys or intermetallic mixtures containing these metals. Preferably for efficient corrosion protection the anode metal will be composed of zinc. The anode as a strip anode can be in strip or similar form, such as a sheet or the like, e.g., foil form. In such strip or similar form, the anode will typically have a thickness within the range of from about 0.01 to about 0.02 inch, and more usually from about 0.02 to about 0.1 inch. The anode need not be a continuous sheet or foil. Instead of a continuous covering of the concrete surface, there may be used anode strips with adjacent strips being spaced apart from each other. Moreover, the anode including the anode strips can desirably be a perforate or porous anode. It is contemplated that over 50% porosity can be present in the anode. Such porosity, or perforations, or both, can leave room for the expansive products resulting from the corrosion of the anode in use. Thus anodes in strip form may be an expanded ribbon or have perforations through the strips, especially if such anodes are not porous. It is to be understood that perforate anode strips can be placed apart from one another to leave void space between strips. It is contemplated that in place of complete coverage of the concrete surface, that coverage of on the order of from about 25% to about 35% of the surface will be sufficient to provide desirable, extended cathodic protection.

It will be understood that in the concrete, the reinforcement metal which is susceptible to corrosion, can be exemplified by iron or iron-containing materials, e.g., steel. It is also to be understood that in almost all service, the metal of the anode will be a sacrificial metal, but particularly where metal strips or wires are used, not all strips and wires need be of sacrificial metal. Moreover, in the innovation disclosed herein wherein the hydrogel serves as a current conductor between adjacent anode bodies, or between a metal anode and a current lead, the metal of the anode may be other than a sacrificial metal.

Referring then to FIG. 1, a steel-reinforced concrete structure 41 has a pothole that presents a concrete surface 42. The pothole is representative of eroded or damaged concrete, usually referred to herein for convenience simply as "eroded" concrete, which concrete is then in need of patching. To this surface 42 there is applied, usually after cleaning such as by sandblasting or shotblasting, a metal-hydrogel strip anode 43 made up of a layer of an anode sheet 14 and a layer of hydrogel 24 each in strip form. As noted in the figure, one broad face of the hydrogel strip 24 is placed face down on the concrete surface 42 and the opposite broad face of the hydrogel strip 24 has the anode sheet 14 adhered thereto. To this strip anode 43, there may then be applied a layer of grout 46, most always a slurry of Type III cement. This grout 46 as applied over the strip anode 43 contacts the anode sheet 14 as well as the sides of the hydrogel strip 24. As in this situation where the strip anode 43 is used in a patch, there will then be applied over the grout 46 additional concrete, not shown.

Figure 2:
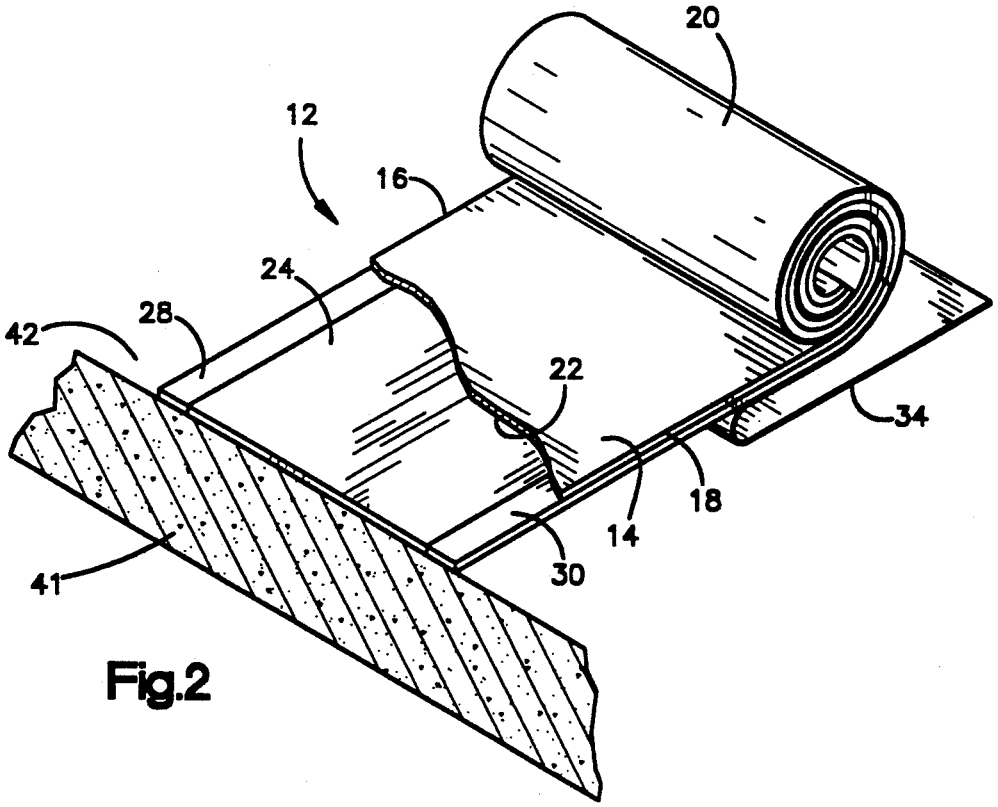
FIG. 2 is a perspective view of one anode structure of the present invention, in roll form, for application to the surface of a reinforced concrete structure.

Referring to FIG. 2, an anode assembly 12 of the present invention comprises an elongated, flexible, nonporous anode sheet 14 which has a generally rectangular configuration although other elongated sheet configurations are contemplated, e.g., elongated anode sheets having curved edges. The sheet 14 is defined on its sides by longitudinally extending edges 16, 18. The sheet 14 has a thickness and degree of flexibility which allows the anode sheet to be characterized as a foil. Thus the anode assembly 12 can be rolled into a compact roll 20, for shipment and storage. At a point of use, the anode assembly 12 can be unrolled from the roll 20 into a generally flat or planar shape, such as onto a surface 42 of a steel-reinforced concrete structure 41.

The anode sheet 14 has on one side 22 a strip of hydrogel 24. The strip of hydrogel 24 has a length which is usually substantially coextensive with the length of the anode sheet 14. The hydrogel strip 24 has pressure sensitive adhesive or tacky properties permitting it to be adhered to the side 22 of the anode sheet 14. The hydrogel is also flexible permitting it to be rolled with the anode sheet 14 into roll 20.

The width of the hydrogel strip 24 is often slightly less than that of the anode sheet 14, so that the anode sheet 14 overhangs the strip 24 at edges 16, 18. A sealant, e.g., caulking material 28, 30, is positioned longitudinally coextensive with the edges 16, 18. The caulking material 28, 30 has a thickness which is the same as, or about the same as that of the hydrogel strip 24. The material is extruded into or otherwise placed along edges of the hydrogel strip 24. The caulking material can be extruded into position from an extrusion gun, or can be applied in the form of caulking strips, or sprayed on as a coating. The material as a caulk may have a width of from less than about ¼ inch to as great as ½ inch or more. Where the material is a sealant such as a coating, e.g., a spray applied sealant coating, the material width will generally have a typical coating thickness, as on the order of less than ¼ inch.

The caulking material 28, 30 should have a high degree of water or vapor impermeability, as well as air impermeability. The purpose of the caulking material 28, 30 is to effectively seal the edges of the hydrogel strip 24 from the environment during storage, shipment and use. It is contemplated that other impermeable sealing material, e.g., adhesive tape, may be used for the caulking material. One side of the hydrogel strip is sealed by anode sheet 14. Exposure of the hydrogel strip 24 to water, e.g., from rain, is particularly deleterious as the hydrogels are very hygroscopic. Also, during use, the caulking material 28, 30, along with the imperviousness of anode sheet 14, prevent the hydrogel strip from losing water either on the side covered by anode sheet 14 or at the interface of the hydrogel strip 24 with the concrete surface to which the assembly 12 is applied. A suitable caulking material is a polyurethane marketed by Products Research & Chemical Corporation under the trademark Permapol RC-1. Also, a silicone caulking material can be used.

The anode assembly 12 also comprises a backing strip 34. This will usually be a plastic strip, although other material can be suitable, e.g., a paper strip having a quick release coating layer. The backing strip 34 has length and width dimensions coextensive with the anode sheet 14. The backing strip 34 is applied to and covers the exposed side of the hydrogel, opposite the side applied against the anode sheet 14. One purpose of the backing strip 34 is to protect the exposed side of the hydrogel strip 24 from the environment. Another purpose is to permit the anode assembly 12 to be rolled into roll 20 without the windings of the roll sticking to one another. The backing strip 34 readily sticks to the hydrogel strip 24 due to the adhesive properties of the hydrogel strip. However, the backing strip, e.g., a polyethylene plastic strip, also has release properties and is readily peeled from the hydrogel strip at a point of use, as shown in FIG. 2.

Although the anode will most always be in strip form, it is to be understood that this form is more broadly contemplated to include sheet or foil or mat form. However, typically as in patching concrete, as where the anode may be immersed or submerged in hydrogel, the anode may take other form, e.g., a chunkybodied form such as ingot form. The anode in strip form, or typically as foil or sheet, is useful if a broad face of the anode is to be adhered to a broad face of a similarly configured hydrogel. However, it will be understood that where the anode can be submerged, i.e., encapsulated, in the hydrogel, there need not be present a broad anode surface. The hydrogel will then usually take a form where it covers more than one surface, or the complete body, of the anode. A particular advantage of having the hydrogel in sheet of strip form covering a face of the anode is for applying the hydrogel to a generally planar concrete surface where the hydrogel can adhere, and thus contribute to the sticking of the anode to the concrete. For patching concrete, presenting a broad hydrogel face to the concrete may not always be of significance, and thus the hydrogel can be suitably in other than strip or sheet form.

Thus, although the anode assembly has been shown in a preferred mode to be in coiled form, such form is not always needed, as in patching concrete. Also, the anode assembly need not have either a plastic backing or a caulk, as in the situation where the anode and hydrogel are freshly brought together and the resulting anode apparatus is to be immediately used, as in patching concrete. However, even when freshly brought together, caulking material can be used to edge the hydrogel in the applied system. When the anode is in place on the concrete, it will frequently be covered. Such covering will often be with a Type III cement which, as has been discussed hereinabove, will be in slurry form. Such cement is particularly serviceable since it is a low resistivity cement. The cement should have a resistivity of less than 100,000 ohm-cm., usually less than 50,000 ohm-cm. and more typically on the order of from about 3,000 to about 15,000 ohm-cm. The Type III cement covering for the anode need not have appreciable depth, e.g., a layer having a depth of no more than a quarter inch, more typically on the order of 1/32 inch of the cement is serviceable.

Although this cement may constitute the total covering for the anode, it is more typical that the cement itself will be covered by concrete. A concrete covering can be particularly useful when the anode assembly is used to patch concrete. This concrete covering is most suitably any Portland cement concrete which is useful for preparing concrete structures, including concrete such as structural concrete, ready mix concrete, low slump concrete, or latex modified concrete.

As has been mentioned hereinabove, the anode may also be covered by a more conventional floor covering, e.g., carpeting. Particularly where the reinforced concrete is near a marine environment and thereby potentially can be effected such as by salt air, it may have a covering other than cement or concrete. For example, reinforced concrete balconies on structures built on ocean-front property can be carpeted. In such instances, the anode may be placed on the concrete surface and under the floor covering.

During the installation of the anode, such as after the assembly in strip form has been adhered to a planar surface of the concrete, there can then be connected to the anode assembly a current lead, e.g., a metal wire or strip. This current lead may contact either the metal anode or the hydrogel of the anode assembly, or both. Moreover, the current lead may itself be a coated current lead, i.e., have hydrogel applied thereto. It has been found that where such is the case, it is suitable to merely press the hydrogel portion of the current lead to the anode assembly, either to the hydrogel or to the metal, or to both. As has been mentioned hereinbefore, this anode assembly may then be connected, with or without a power source, to the concrete reinforcement.

The following Examples show ways in which the invention has been practiced but should not be construed as limiting the invention.

EXAMPLE 1

For test purposes, concrete blocks were prepared from Type I Portland cement, silica sand fine aggregate and 1 inch minus coarse aggregate in a weight proportion of cement to sand to coarse aggregate, on a per cubic yard basis, of 1:2:2.95. Each block measured one square foot by six inches thick and contained eight steel reinforcing bars in double-layer construction. The concrete was cured by spraying the surface at a rate of 200 square feet/gallon with a water-based curing compound (Masterkure TM ) followed by setting the concrete aside for 28 days.

The steel reinforced concrete test block thereby provided a one-square foot test surface that was sand blasted to remove laitance. The test anodes employed had a layer of zinc and a layer of hydrogel and were in strip form. For each strip, the zinc layer was a sheet of about 99% purity, having a thickness of about 0.016 inch. The hydrogel layer side of the zinc-hydrogel strip anode had a thickness of about 0.040 inch and a resistivity of about 800 ohm-cm. The hydrogel was based on an acrylic-sulfonamide copolymer and was marketed by the Promeon Division of Medtronic, Inc., type No. RG63B, and had an electrolyte comprising water containing potassium chloride. The zinc-hydrogel anode is made by first removing a plastic film covering from one side of a strip of hydrogel. The zinc strip is next applied to the exposed hydrogel strip and the combination is then rolled together to firmly adhere the zinc with the hydrogel.

Six of these zinc-hydrogel strip anodes, each ½ inch wide, are placed on the one-square foot test surface of the block by removing a plastic film covering from the hydrogel on the side opposite the zinc. The anode is then placed hydrogel-side-down on the concrete. The first strip is located 2 inches from an edge of the block and the remaining five strips are applied to the block parallel to the first strip. The strips are 1 inch apart from each other. Each strip is 11⅜ inches long so as not to come quite to the edge of the block at each strip end. Each zinc-hydrogel anode strip is, in addition to the adhesion provided by the hydrogel, held in place against the concrete by nylon rivets. Holes are first drilled in the concrete next to the strips, then the rivets are tapped into the holes so that a portion of the rivet head is over the anode strip. At one edge of the block where the anode test strips come almost to the block edge, a connector strip is placed perpendicular to the anode strips, connecting over the anode strips at their ends. This is a zinc-hydrogel connector strip, placed hydrogel-side-down on the top zinc layer at the ends of the anodes. There is thereby made a zinc-hydrogel-zinc connection between the anode strips and the connector strip. This connector strip extends beyond an edge of the block to provide subsequent connection with concrete reinforcement.

A Type III cement/water slurry is brushed onto the concrete test surface which had first been wetted with water. To the resulting thusly prepared concrete test surface there was then applied a two-inch thick overlay of Portland cement concrete (KWIK MIX supplied by Union Sand and Gravel Co.). The zinc-hydrogel connector strip was then connected directly to the concrete reinforcement through a one ohm resistor.

For comparative purposes, the procedure as detailed above was repeated, but the anode test strips, as well as the connector strip, were merely zinc test strips, rather than zinc-hydrogel anode test strips. Otherwise, procedures and constituents were the same. The autogenous, or self-impressed, current flow for the connected anode and reinforcement for the two test blocks was then monitored. The testing was initiated indoors and on the 29th day, the blocks were moved outdoors.

After moving outdoors, for the next approximately 60 days of the test, the block with the plain zinc anodes had a current reading, in milliamps, varying essentially between 0.5–1 milliamp. However, for the test block with the zinc-hydrogel anodes, such readings varied consistently between 1.5–3.5 milliamps. For approximately the next 80 days on test the block with the zinc anodes provided a fairly consistent anode reading of 0.5 milliamp. Comparatively, the block with the zinc-hydrogel anodes had readings varying between 0.5–3 milliamps. During approximately the next 90 days of this test, consistent current readings were obtained from the block with the zinc anodes of below 0.5 milliamp. During this time the zinc-hydrogel anodes had current readings of 0.75–1.5 milliamps. This selfimpressed final current flow for the zinc-hydrogel anodes, during each test measurement, was essentially double to triple the current achieved for the plain zinc anodes, for the last 90 days of test. At 260 days of the test, the current for the zinc anodes fell to almost zero and the test for these anodes was terminated. In contrast, the zinc-hydrogel anodes continued to produce readings varying generally from 1 to 1.5 milliamps.

EXAMPLE 2

A steel-reinforced concrete test block as described in Example 1 was used and was prepared in the manner of Example 1. Zinc-hydrogel strip anodes as discussed in Example 1 were also used. However, before making the anodes, the plastic film covering for the hydrogel strips was removed from one side of the hydrogel and magnesium chloride powder was uniformly distributed over the exposed side of the hydrogel. The plastic film covering was replaced and the hydrogel was rolled to embed the magnesium chloride salt. The plastic film covering was then removed completely from the hydrogel and the salt side was pressed against zinc strips. This provided salt-modified, zinc-hydrogel strip anodes. Otherwise, these anodes were as described in Example 1.

The salt-modified strip anodes were then placed on the test surface of a test block. The block and the anode positioning was as described in Example 1 except that five anode strips were used in parallel and these were centered on the test surface of the block spaced 1¼ inches apart. A sixth strip using salt-modified hydrogel was placed at the edge of the block perpendicular to the five salt-modified test strips in the manner as described in Example 1 to provide a connector strip extending beyond one edge of the test surface. This zinc current lead (connector strip) was connected, by soldering, directly to the concrete reinforcement through a one ohm resistor. All exposed edges of the anode strips were sealed with a commercial silicone sealant to keep out moisture (RTV Silicone from Dow-Corning Corporation).

For comparative purposes, the procedure as detailed above was repeated, but the anodes were merely zinc test strips rather than zinc-hydrogel, salt-modified, anode test strips. Otherwise, procedures and constituents were the same. The self-impressed current flow, in milliamps, for the connected anode and reinforcement for the two test blocks was then monitored. Over the first 32 days of test, the salt-modified anode test strips provided consistently higher current flow, ranging from an about 0.5 to about 1.5 milliamps higher current flow (excepting for one anomalous, coincident reading occurring during a rain storm). Over a subsequent 63 days of test, a few more coincident readings were obtained, but in general the salt-modified anode test strips continued their higher current flow.

EXAMPLE 3

A steel-reinforced concrete test block as described in Example 1 was used and was prepared in the manner of Example 1. The zinc-hydrogel strip anodes used were the salt-modified anodes as discussed in Example 2.

The salt-modified strip anodes were then placed on the test surface of the block. This was done in the manner as described in Example 1 except that five anode strips were used as described in Example 2. A sixth strip using salt-modified hydrogel was placed at the edge of the block perpendicular to the five salt-modified test strips to provide a connector strip (current lead) extending beyond one edge of the test surface. The concrete test surface was then brushed with a Type III cement-/water slurry and next had applied thereto a 2 inch thick overlay of Portland cement concrete, all as has been described in Example 1. This zinc current lead was connected directly to the concrete reinforcement, by soldering, through a one ohm resistor.

For comparative purposes, the procedures as detailed above in this example were repeated, but the anodes were merely zinc test strips rather than zinchydrogel, salt-modified, anode test strips. Otherwise, procedures and constituents were the same. The selfimpressed current flow, in milliamps, for the connected anode and reinforcement for the two test blocks was then monitored. Over a 46-day test period, the salt-modified anode test strips were found to virtually always provide essentially the same to usually higher current flow (9 out of 10 readings), with 0.5–1 milliamp higher readings being typical.

EXAMPLE 4

A steel-reinforced concrete test block as described in Example 1 was used and was prepared in the manner of Example 1. The zinc-hydrogel strip anodes used were the anodes of Example 1.

The strip anodes were then placed on the test surface of the block. This was done in the manner as described in Example 1 except that five anode strips were used as described in Example 2. A sixth strip was placed at the edge of the block perpendicular to the test strips to provide a connector strip (current lead) as described in Example 1, except that one end of this strip is bent 90° perpendicular to the test surface of the block. The concrete test surface was then brushed with a Type III cement/water slurry and next had applied thereto a 1¾ inch thick overlay of the Portland cement concrete described in Example 1, but being a mixture of the concrete with Type III cement in a weight ratio of 60:3.12. The overlay was water cured. The bent end of the zinc current lead extended upwardly through this overlay and was connected directly to the concrete reinforcement, by soldering, through a one ohm resistor.

For comparative purposes, the procedures as detailed above in this example were repeated, but the anodes on the test surface were brushed with Type I cement, rather than Type III cement and the overlay was made with Type I cement, rather than Type III cement. Otherwise, procedures and constituents were the same. The self-impressed current flow, in milliamps, for the connected anode and reinforcement for the two test blocks was then monitored. Over a nearly four-week test period, the anode test strips under the Type III cement were found to always provide higher current flow, typically of 20% or more.

EXAMPLE 5

A steel-reinforced concrete text block as described in Example 1 was used and was prepared in the manner of Example 1. The zinc-hydrogel strip anode used was the type of anode of Example 1 but comprised an 8 inches by 11⅜ inches zinc sheet having a hydrogel strip of slightly lesser dimensions. The hydrogel strip adhered well to the concrete surface, using only hand pressure, and conformed well to irregularities of the surface. A polyurethane caulking material was applied to edges of the hydrogel strip subsequent to application of the assembly to the concrete. After allowing the caulking to dry, the section of concrete was energized by attaching one lead of a power supply to the zinc anode, and the other lead to the concrete reinforcement. The section was energized at a current density of two milliamps per square foot of anode, or 1.26 milliamps per square foot of concrete. The anode to reinforcement resistance initially was 27 ohms.

During the first ten days while energized, voltage readings were taken, which were negative at about minus 0.4–0.5 volt. This suggested that the system of the present invention was functioning to produce a current flow on its own, without the need of a power supply.

The power supply was then removed from the cathodic protection system, and the anode was connected directly to the concrete reinforcement through a one ohm resistor. Current readings were taken periodically. The following results were obtained:

TABLE

| Days On Line | Current Reading in Milliamps | Current Density Based on Area of Anode-Milliamps Per Scuare Foot |
|---|---|---|
| 10 | 4.6 | 7.3 |

TABLE-continued

| Days On Line | Current Reading in Milliamps | Current Density Based on Area of Anode-Milliamps Per Scuare Foot |
|---|---|---|
| 11 | 2.9 | 4.6 |
| 17 | 7.5 | 11.9 |
| 20 | 6.2 | 9.8 |
| 24 | 1.2 | 1.9 |
| 26 | 1.3 | 2.06 |
| 32 | 4.5 | 7.14 |
| 46 | 3.1 | 4.92 |
| 54 | 2.0 | 13.2 |
| 59 | 9.4 | 14.9 |
| 63 | 5.4 | 8.6 |
| 74 | 5.3 | 8.4 |
| 97 | 2.5 | 4.0 |
| 115 | 4.9 | 7.8 |
| 122 | 2.6 | 4.13 |
| 129 | 1.2 | 1.90 |
| 136 | 1.4 | 2.22 |
| 143 | .8 | 1.27 |

At the end of 143 days on line, a three inch by eight inch section of the anode/hydrogel assembly was analyzed. The overall appearance was good. Little or no etching was seen on the concrete. A layer of $ZnO/Zn(OH)_2$ existed on the surface of the concrete. The zinc sheet was only slightly etched.

For comparison, a zinc anode coating cathodic protection system, flame-sprayed onto the concrete, as disclosed in U.S. Pat. No. 4,506,485, cited above, is designed to function using a current flow of about two milliamps per square foot of concrete. The life expectancy sought for such a system is about ten years. In this Example, the current density, as shown in the above Table, far exceeded normal. This accelerated obsolescence and shortened useful life. Based on analysis, it was estimated that about 10% of the life of the system had been consumed, and that about 90% of the life of the system remained. The resistor placed between the anode and steel, reducing the current density, extends the life expectancy to be more equivalent to that normally sought.

In the present invention, the ability of the apparatus to operate for a prolonged period, with or without a source of power, is surprising. Concrete has a relatively high resistivity and requires, for cathodic protection, a relatively high voltage. When zinc dissolves, in conventional systems, for instance that of U.S. Pat. No. 4,506,485, the zinc ions tend to move into the concrete. Concrete has a high pH of about 12.5, causing the zinc to precipitate in the concrete as zinc hydroxide. Zinc hydroxide has a low conductivity. In addition, a zinc coating which is flame sprayed onto a concrete surface is relatively porous. This allows the concrete, at the interface with the zinc coating, to dry out. This absence of moisture at the interface in combination with the zinc hydroxide precipitate creates a barrier to the flow of electricity in the concrete requiring use of a power supply. In the present invention, this formation of an electrical barrier in the concrete is repressed allowing the system of the present invention to be operated without a power source. Although not to be bound by any theory, it is believed that this is due, at least in part, to the ability of the system of the present invention, to maintain a high moisture content at the interface of the system with the concrete.

We claim:

1. A method of patching an eroded area, such as a pothole, within the surface of a reinforced concrete structure, which method comprises:
   (a) initiating said patching by removing old concrete from the eroded area to prepare said area for patching;
   (b) inserting within the resulting prepared area for patching a cathodic protection anode assembly comprising a metal anode having ionically conductive hydrogel adhered to said anode, said hydrogel of said assembly being also adhered to the concrete of the prepared area;
   (c) applying Type III cement to cover said anode assembly within said area for patching; and
   (d) connecting the metal anode of said assembly in electrical connection to the reinforcement of said concrete structure.

2. The method of claim 1, wherein said metal anode and ionically conductive hydrogel are flexible.

3. The method of claim 2, including the step of conforming the anode within the prepared area to the concrete by pressure application to said surface, the metal anode being in foil form.

4. The method of claim 1, including the step of carrying out said cathodic protection with or without a power source.

5. The method of claim 1, wherein said connection has a resistance which maintains the current density from the metal anode to the concrete surface.

6. The method of claim 1, wherein said metal anode is embedded in said ionically conductive hydrogel.

7. The method of claim 1, including the step of supplying said ionically conductive hydrogel with a salt.

8. The method of claim 1, including the step of applying concrete over said Type III cement.

9. In a method for cathodically protecting a reinforced-concrete structure, wherein a metal anode is used in connection with reinforcement for said structure, the improvement comprising combining a metal anode with an ionically conductive hydrogel on at least a portion of the surface of said metal and connecting said metal anode, through electrical connection means including said hydrogel, with concrete structure reinforcement, wherein said metal of said anode is a sacrificial metal selected from the group consisting of zinc, aluminum, magnesium, and alloys and intermetallic mixtures thereof.

10. In a reinforced concrete structure comprising an anode in electrical connection with reinforcement for cathodic protection thereof, where a current lead in said structure connects with said anode, the improvement comprising a current lead comprising, in combination, metal plus hydrogel, wherein said anode is a metal anode and the metal of said anode is a sacrificial metal selected from the group consisting of zinc, aluminum, magnesium, and alloys and intermetallic mixtures thereof.

11. A method of patching an eroded area, such as a pothole, within the surface of a reinforced concrete structure, which method comprises:
   (a) initiating said patching by removing old concrete from the eroded area to prepare said area for patching;
   (b) inserting within the resulting prepared area for patching a cathodic protection anode assembly comprising a metal anode having ionically conductive hydrogel adhered to said anode, said hydrogel of said assembly being also adhered to the concrete of the prepared area;

(c) connecting the metal anode of said assembly in electrical connection to the reinforcement of said concrete structure; and (d) applying Type III cement to cover said anode assembly within said area for patching.

12. A method of patching an eroded area, such as a pothole, within the surface of a reinforced concrete structure, which method comprises:

(a) initiating said patching by removing old concrete from the eroded area to prepare said area for patching;

(b) inserting within the resulting prepared area for patching a cathodic protection anode assembly comprising a metal anode having ionically conductive hydrogel adhered to said anode, said hydrogel of said assembly being also adhered to the concrete of the prepared area;

(c) connecting the metal anode of said assembly in electrical connection to the reinforcement of said concrete structure; and (d) applying a cementitious cover to said anode assembly within said area for patching; and further, with the proviso that step (d) may be performed before step (c).

* * * * *